US007891348B2

(12) United States Patent
Colley

(10) Patent No.: US 7,891,348 B2
(45) Date of Patent: Feb. 22, 2011

(54) COMPACT CROSSBOW WITH IMPROVED EFFICIENCY

(76) Inventor: David E. Colley, 1715 Ozora Rd., Loganville, GA (US) 30052

( * ) Notice: Subject to any disclaimer, the term of this patent is extended or adjusted under 35 U.S.C. 154(b) by 449 days.

(21) Appl. No.: 12/101,417

(22) Filed: Apr. 11, 2008

(65) Prior Publication Data

US 2008/0251058 A1 Oct. 16, 2008

Related U.S. Application Data

(60) Provisional application No. 60/911,717, filed on Apr. 13, 2007.

(51) Int. Cl.
*F41B 5/12* (2006.01)

(52) U.S. Cl. ..... 124/25; 124/25.6

(58) Field of Classification Search ..... 124/23.1, 124/25, 25.6, 86, 88
See application file for complete search history.

(56) References Cited

U.S. PATENT DOCUMENTS

| | | | | |
|---|---|---|---|---|
| 3,515,113 | A | 6/1970 | Lawrence | |
| 3,854,467 | A | 12/1974 | Hofmeister | |
| 3,874,359 | A | 4/1975 | Cesin | |
| 3,967,609 | A | 7/1976 | Frydenlund | |
| 3,987,777 | A | 10/1976 | Darlington | |
| 3,989,026 | A | 11/1976 | Nishioka | |
| 3,993,039 | A | 11/1976 | Groves et al. | |
| 4,287,867 | A | 9/1981 | Islas | |
| 4,388,914 | A | 6/1983 | Cesin | |
| 4,457,287 | A | 7/1984 | Babington | |
| 4,457,288 | A | 7/1984 | Ricord | |
| 4,458,657 | A | 7/1984 | Stockmar | |
| 4,461,267 | A | 7/1984 | Simonds et al. | |
| 4,593,674 | A | 6/1986 | Kudlacek | |
| 4,651,707 | A | 3/1987 | Bozek | |
| 4,711,228 | A | 12/1987 | Gillespie | |
| 4,722,317 | A | 2/1988 | Hartwig | |
| 4,722,318 | A * | 2/1988 | Yankey | 124/25 |
| 4,757,799 | A | 7/1988 | Bozek | |
| 4,781,168 | A | 11/1988 | Lester | |
| 4,860,719 | A * | 8/1989 | Scheiterlein | 124/25 |
| 5,119,797 | A * | 6/1992 | Anderson | 124/25 |
| 5,388,564 | A | 2/1995 | Islas | |
| 5,503,135 | A | 4/1996 | Bunk | |
| 5,638,804 | A | 6/1997 | Remick et al. | |
| 5,720,267 | A | 2/1998 | Walk | |
| 6,244,259 | B1 | 6/2001 | Adkins | |
| 6,267,108 | B1 | 7/2001 | McPherson | |
| 7,047,958 | B1 | 5/2006 | Colley | |

* cited by examiner

*Primary Examiner*—John Ricci
(74) *Attorney, Agent, or Firm*—Shoemaker and Mattare

(57) ABSTRACT

A "cross-over" compound crossbow includes a stock and barrel assembly attached to a horizontally mounted compound bow. The compound bow component is similar to that of U.S. Pat. No. 7,047,958 and includes an alternative arrow support system to achieve higher arrow velocity at a reduced draw weight. The crossover compound bow also provides draw weight adjustability and positive cam synchronization.

9 Claims, 2 Drawing Sheets

COMPACT CROSSBOW WITH IMPROVED EFFICIENCY

This application claims benefit of provisional patent application Ser. No. 60/911,717, filed Apr. 13, 2007.

BACKGROUND OF THE INVENTION

This invention relates generally to archery equipment and more specifically to crossbow type devices.

The crossbow is an ancient weapon that has remained relatively unchanged over the centuries and up to modern times. The crossbow has a number of advantages over the traditional or conventional archery bow configuration. One such advantage is that the crossbow uses a stock that allows the device to be supported, aimed and fired using a trigger much in the same manner as a rifle. Yet another advantage that a crossbow provides is that the bowstring is mechanically held in the fully drawn position eliminating the need for the archer to physically hold the fully drawn bowstring while aiming and shooting the device. These two advantages are among the primary reasons that the crossbow is sometimes chosen over the traditional bow configuration. Another aspect of the crossbow that is often mistaken for an advantage is that the crossbow utilizes a much higher poundage draw weight than the regular bow, leading some to believe that the that the crossbow must be a more efficient and more powerful weapon than the bow.

In reality, however, even in the case of the more modern versions of the crossbow where compound bow type limb mounted cams are used in order to increase the stored energy, this is not the case. The dimensional limitations of the conventional crossbow restrict the power stroke to a very short length as compared to a bow. In order to compensate for the relatively short power stroke, an extremely high draw weight must be used in order for the crossbow to obtain projectile velocity that approaches or is equal to the arrow velocity obtained from a conventional bow. Further, the necessity to employ such high draw weight dictates that the projectile take the form of a very rigid, strong and heavy object commonly known as a bolt as opposed to an arrow which can be more closely matched in terms of weight and spine to the draw weight in order to optimize efficiency. Thus the crossbow is, comparatively, a much less efficient device than the bow. Subsequently, the requirement of an extremely high draw weight, in many cases, makes the crossbow either undesirable or even unusable for a number of archers due to the difficulty encountered in drawing and cocking the device. Although a number of unique devices have been developed to assist in drawing and cocking the heavy pull weight of a crossbow, such devices are normally cumbersome, elaborate, tedious, or equally uncomfortable and inconvenient to use.

Some modern versions of the crossbow utilize limb mounted cams similar to those used on compound bows in order to improve the energy storing capability of the device relative to the power stroke restrictions and draw length requirements. In addition, some examples utilize the cams and axle-to-axle length to increase the power stroke, which has improved performance to a degree. However, using limb mounted cams on a crossbow in the same manner that they are used on a conventional compound bow introduces the same undesirable conditions such as limb twist, cam lean, and asymmetrical loading to the projectile as well as various components that occur with conventional compound bow design.

In order to compensate for the inherent inefficiencies of the conventional compounding system along with an increased mass at the limb tips, the highest draw weight possible must be used. However, although the draw weights used are substantially in excess of that of a compound bow, it is usually impractical to design the components of a compound type crossbow such that they would withstand the somewhat higher forces that may be used with traditional, re-curve limb type crossbows. This usually makes the traditional, re-curve type crossbow actually faster and, in view of the absence of the inherent inefficiencies of the conventional compounding system, more efficient. Of course, the higher poundage of the traditional crossbow that is dictated by the short power stroke, again, makes such a configuration undesirable in many cases.

Due to the dynamic forces applied to the bolt (projectile) used with the common crossbow, the common method of supporting the bolt at full draw is that of a channel or groove deployed along the upper portion of the barrel in which the bolt rests with a positioning groove in the riser to center the bolt in the channel and a spring type finger to hold the rear of the bolt in place near the fletching. While this means of supporting the bolt in a crossbow is necessary, it also lends to the inefficiency of the device to a degree in that a lengthy duration of contact between the bolt and the barrel is experienced during launch.

Therefore, it can be easily recognized that it would be most desirable to create a modern crossbow type device that possesses the most desirable features of the crossbow such as a configuration that utilizes a rifle type stock to facilitate supporting, aiming, and shooting the weapon and the feature of mechanically cocking, holding and releasing the bowstring using a trigger mechanism, while providing the power, accuracy and efficiency of a compound bow without the requirement for excessively high draw weight and without the inherent efficiency and accuracy problems that exist with conventional compound bow systems.

A relatively new form of compound bow designed to eliminate the problems associated with conventional compound bow design relative to efficiency, accuracy performance, lack of versatility, and other aspects is shown in my U.S. Pat. No. 7,047,958, the disclosure of which is incorporated herein by reference.

SUMMARY OF THE INVENTION

An object of the present invention is to adapt the unique geometry and other features of my compound bow design to a crossbow type configuration using aspects of the conventional crossbow design such as the stock and trigger/release mechanism to create a hybrid device possessing the most desirable features and aspects of both while eliminating the undesirable features and aspects of the common crossbow. I refer to this hybrid device hereafter as a "crossover bow".

Another object of the present invention is to provide a crossover bow that incorporates other desirable features found on both the compound bow and the crossbow with respect to the mounting of accessories, safety features, dimensional adjustability, and the like.

Yet another object is to provide a crossover bow that includes new and unique beneficial features not commonly found on conventional crossbows such as a positive synchronizing system and a fully adjustable draw weight.

In the present invention, a riser member is located at the front portion of the device. The riser member serves as a means of mounting and supporting the limb assemblies, the pylons that support the cam and spool assemblies, the limb bolt adjustment means, the arrow rest, the foot stirrup, a bow quiver and other attachments. The limb assemblies are horizontally deployed in the same fashion as a crossbow. The pylon mounted cam and spool assemblies are supported and arranged in a fashion similar to that shown in U.S. Pat. No. 7,047,958 and the cabling and operational system features function in essentially the same manner.

Many of the operational, geometrical, and functional aspects of the former invention are easily adaptable and applicable to use with the present invention. The use of the intermediate spool feature of my prior invention allows for an exceptionally short axle-to-axle length while, at the same time, allowing for a relatively long power stroke. The unique cabling configuration that allows each pylon mounted cam to function with respect to the adjacent limb assembly as opposed to the opposite limb assembly effectively isolates limb and cable loads and eliminates the transmission of forces through the riser in the same manner as the former invention and with the same advantages.

The riser assembly is attached to a stock assembly. The stock assembly may be configured in a similar fashion as that of stock assemblies used on conventional crossbows.

The stock also includes a forward grip with a forward trigger mechanism (the forward grip and trigger configuration being relatively common to the construction of both firearms and crossbows), a release mechanism that functions in conjunction with the trigger mechanism to release the bowstring from its cocked position, and a safety mechanism for the trigger/release apparatus. Designs for such trigger/release/safety mechanisms are commonly known and have been commonly in use in both firearm and crossbow design for such a length of time that a detailed description of such an assembly is not warranted herein.

The stock assembly may also comprise an adjustable buttpad or plate in order to adapt the length of pull to individuals of different stature. The stock assembly may further include an adjustable, raised cheek-piece and a means for mounting a scope or sight, both of which are common and have long been used in both firearms and crossbows.

In the present invention, the use of an arrow as opposed to a bolt is acceptable allowing for weight, spine, and other arrow specifications to be in accordance with those requirements that would normally be associated with conventional compound bows rather than the "bolt" requirements of a crossbow. This feature provides a wide range of flexibility with respect to arrow specification. Further, in the present invention, the arrow is supported in the fully drawn and cocked condition by means of a traditional arrow rest at the front of the arrow, just rearward of the point and by a traditional arrow nock at the bowstring. This configuration of support, similar to that of a compound bow, is substantially more efficient than the method common to conventional crossbows.

The limb assemblies of the present invention are adjustable with respect to their preload by means of pylon mounted, rotating limb bolt anchor means that engage limb adjustment bolts essentially as shown in U.S. Pat. No. 7,047,958, allowing the present invention to be adjustable with respect to peak draw weight and to allow for the complete reduction of all tension in the cables and bowstring so that a bow-press is not required to accomplish any necessary work or maintenance task. Typically, modern crossbow design does not allow for peak weight adjustment due to the fact that a set draw weight is mandatory in order that the crossbow can perform as effectively as possible. However, because the present invention utilizes the highly efficient technology, geometry, and design features of the invention of U.S. Pat. No. 7,047,958, the crossover bow is capable of producing performance that is not only adequate but also highly effective for hunting purposes at peak draw weight settings as low as 40 pounds. By comparison, the crossover bow can provide speed, performance, kinetic energy, and accuracy at approximately 100 pounds of peak draw weight that exceeds the performance in every respect of a conventional compound type crossbow using a draw weight of 175 pounds or more. Being an effective hunting weapon at such a lower draw weight range allows the present invention to be more useful for a wider range of archers and others who would otherwise find the extremely high poundage of the conventional crossbow undesirable.

One of the principal departures from conventional crossbow design is that the use of the compound bow structure disclosed herein allows for a relatively short (23 inch or less) axle-to-axle length while allowing for a relatively long (18 inch or more) power stroke. Further, because of the distinctly superior dynamic performance provided by the mechanism's geometry, such a configuration applied to a crossbow type device would allow the peak draw weight to be limited to a 100 to 150 pound range if desired while nevertheless providing arrow velocity, performance and accuracy far superior to that of a conventional 175-pound or higher crossbow.

Because the present invention comprises features that insure that no asymmetrical loading is imparted to the arrow, conventional arrows and nocks such as those used for conventional compound bows may be used. In fact, is has been determined that conventional arrows and nocks used with the present invention perform exceptionally well at peak draw weights up to 150 pounds. The ability to use conventional arrows and nocks as opposed to "crossbow bolts" provides a broad range of flexibility with respect to arrow selection. Furthermore, the superior performance at reduced peak draw weight ranges coupled with the flexibility provided by an adjustable length of pull allow the crossover bow to be used by virtually anyone of any stature and without the fear that is sometimes associated with the extremely high poundage of conventional crossbows.

The present bow can be an extremely effective hunting bow even when used at poundage in the 40-pound range, further increasing its versatility and appeal to a broad range of individuals. Providing the ability to adjust the poundage to a point of zero tension allows for bowstring or cable replacement or other maintenance tasks without the requirement of a bow-press.

The bow preferably includes a disk-type arrow rest mounted to the barrel, but it could take the form of another type of arrow rest or support. The release mechanism for the bowstring that is operated by the forward located trigger is configured so as to accept a standard arrow nock securely located at the center of the bowstring. As a further distinction from the conventional crossbow, the inventive crossover bow supports the arrow in virtually the same manner as a standard bow, not requiring the use of a support channel or groove in the barrel or the use of a spring "finger" to secure a bolt. The release mechanism is a self-cocking type with a built-in safety mechanism similar to that used on a conventional crossbow or rifle.

BRIEF DESCRIPTION OF THE DRAWINGS

In the accompanying drawings.

DESCRIPTION OF THE PREFERRED EMBODIMENT(S)

Figure 1:
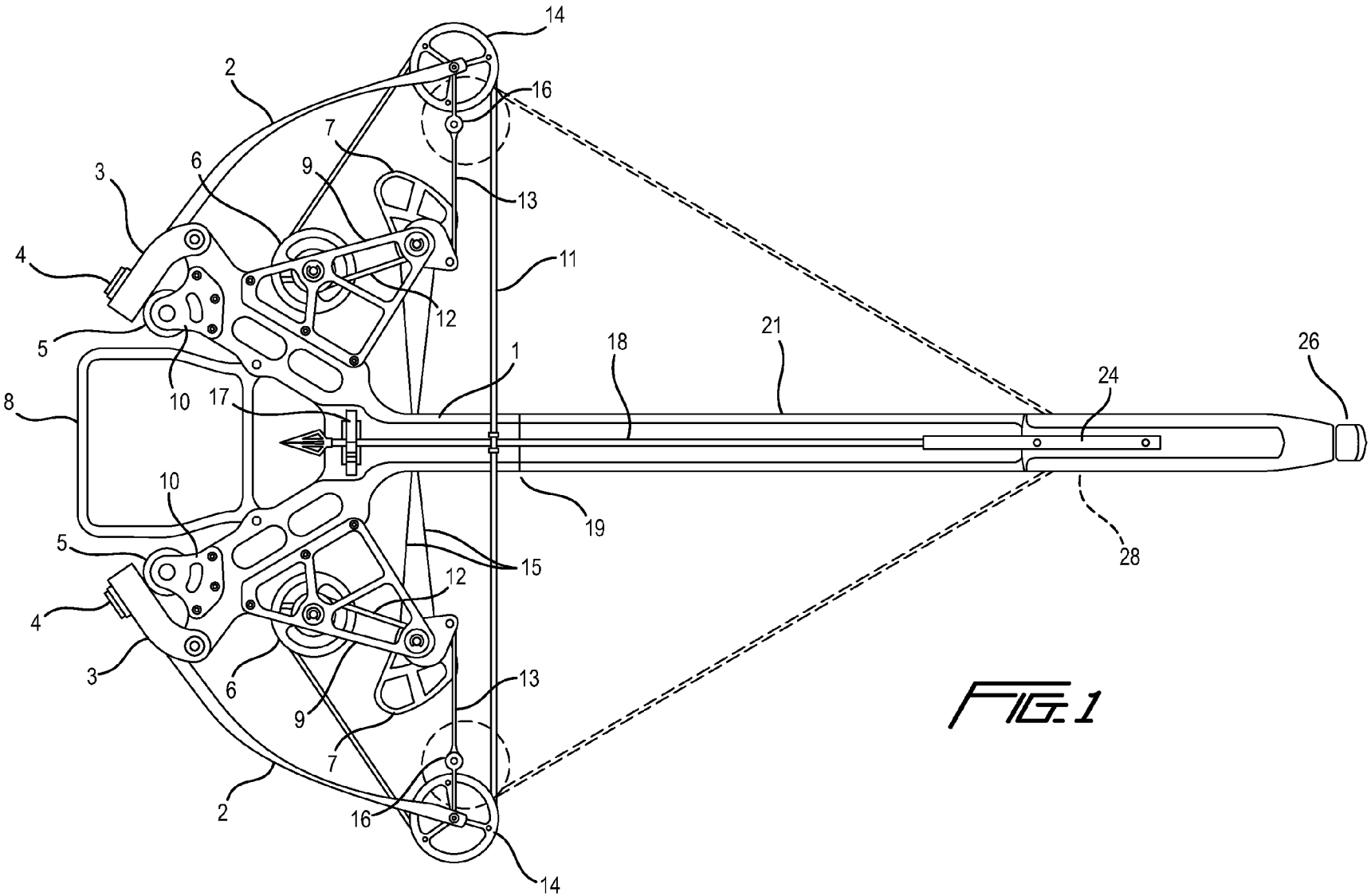
FIG. 1 is a top plan view of a crossbow embodying the invention.

As shown in FIG. 1, a bow embodying the invention comprises a riser 1 which supports at either end a limb 2 whose inner end is pivotally seated in a limb pocket 3 at the end of the riser.

The riser, as seen in FIG. 1, is symmetrical. Its opposite wings support respective identical bowstring tensioning mechanisms. Each tensioning mechanism includes an adjustment bolt 4 installed in a limb bolt anchor 5. Each anchor is supported by a respective front pylon 10 formed from a first pair of plates, one on either side of the riser. The rear pylons 9 are discussed further below.

The angular position of each pocket, and thus its limb, can be adjusted by turning the adjustment bolt 4. The bolt is sufficiently long to maintain adequate thread engagement over the range of from no limb preload to the maximum permissible limb preload. This way, the bolts can be safely unscrewed until the limbs are fully relaxed, permitting disassembly of the bow without the danger of unexpected energy release, and without requiring the use of a press during disassembly.

A foot stirrup 8, which is used when cocking the bow, is attached between the ends of the riser.

Each limb tip is split by a slot, and an idler wheel 14 is supported on an axle between the split ends.

Each rear pylon 9 supports a bowstring spool 6, which is mounted on a common axle with a cam spool, and has a bowstring anchor lug.

Each rear pylon also supports a cam 7 which has a major lobe and a minor lobe. The bowstring spool and the cam are interconnected, and turn in unison. The cam spool and the cam are interconnected by a drive cable, one end of which is wound on the cam spool. The other end of the drive cable extends around a groove in the periphery of the major lobe of the cam and has a terminator which seats in a hole in the cam.

The bowstring 11 has eyes at either end; these are anchored by respective bowstring anchor lugs. The bowstring runs in the bow's center plane (which bisects the riser and both limbs) from the upper anchor lug, around the perimeter of the upper bowstring spool 6, thence around a portion of the grooved perimeter of each idler wheel 14, and finally around the lower bowstring spool to its anchor lug.

Figure 2:
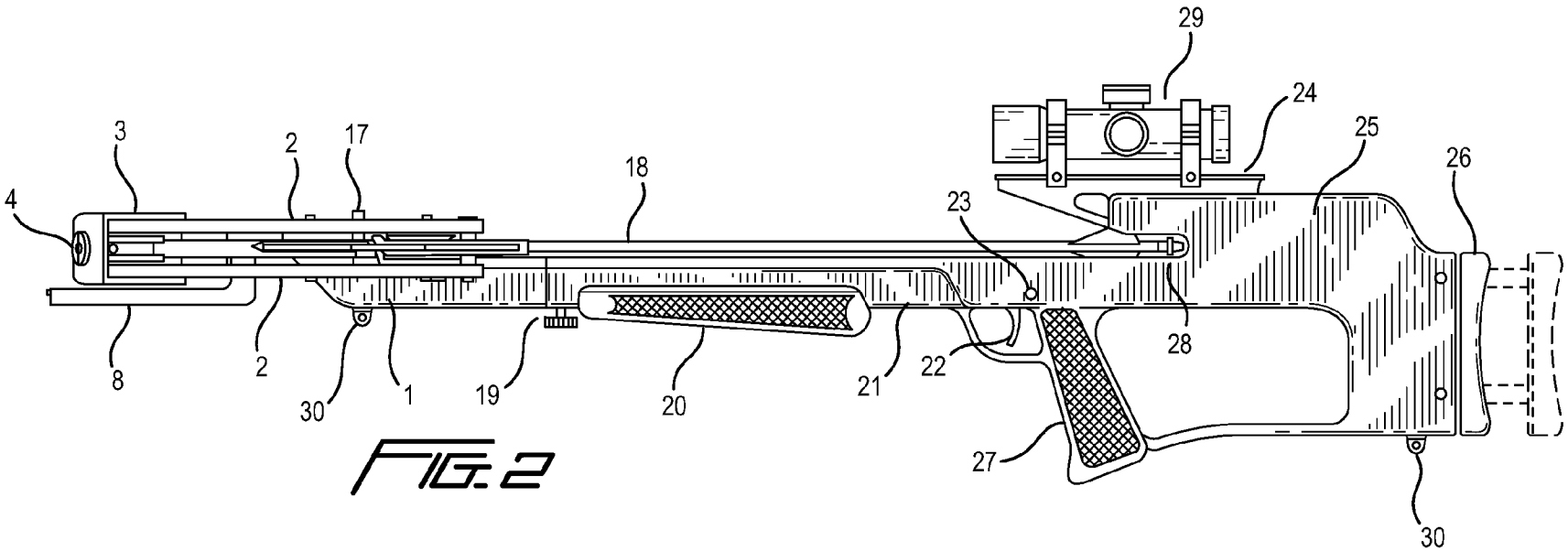
FIG. 2 is a side elevation thereof.

At either end of the bow, a buss cable 13 connects the minor lobe of a cam 7 to the distal end of one flexible limb. Each buss cable extends from the minor lobe to a buss cable bracket 16 which has spaced arms straddling the idler wheel and connecting to the axle on either side thereof (FIG. 2). The spaced distal ends of the limbs also straddle the idler wheel, outboard of the bracket.

The bowstring and cables for the cams and intermediate spools are preferably made of strong synthetic fibers. Nylon-coated steel cables are preferred for the synchronizing cables.

The movement of the left and right cam mechanisms is synchronized, so that their angular orientation is always equal and opposite, by two synchronizer cables 15, which run in grooves on synchronizer spools. These cables run in closely adjacent planes, both to one side of the center plane in which the bowstring lies. Each end of each synchronizer cable 15 is fixed to one of a pair of opposed points on the respective synchronizer spools, causing them to turn equally in opposite directions at all times. This insures that the limbs are equally stressed.

FIG. 2 shows the stock 21 to which the barrel 19 and riser 1 are attached.

An arrow rest 17 is situated on the top surface of the riser above the longitudinal centerline of the bow. An arrow 18 is shown in place on the rest. The rear nocked end of the arrow can be seen in FIG. 2, the bowstring 11 having been omitted from this view. The arrow is supported only by the rest at the front and the bowstring at the rear. This avoids the generation of speed-robbing friction or flexure-inducing side forces when the arrow is launched.

The string is held by release a mechanism 28 until it is released by a pull of the trigger 22. The trigger is locked when desired by a safety 23. The grip 27 is situated behind the trigger.

The stock houses the trigger, which is located forward of the bowstring release mechanism. The configuration resembles what is sometimes referred to as a "bull-pup" configuration for rifles. At the rear of the stock is a butt pad 26 to engage the shoulder. It may be adjustable to accommodate different length of pull requirements. A forearm piece 20 is located just ahead of the trigger guard and may be adjustable for position as well. Somewhat ahead of the forearm piece, the riser portion of the bow is attached to the barrel and stock assembly. A scope-mounting rail 24 may be positioned along the top of the butt-stock just ahead of the raised cheek-piece as shown at area 25 or to another convenient location. An optional scope 29 is illustrated. Item 30 is a sling mount.

This invention is subject to many variations and changes in detail. The bow described above, and shown in the drawings, should be understood to be just one embodiment of the invention described by the claims below.

What is claimed is:

1. A compound crossbow comprising:

a stock having a butt end and a fore end, said stock supporting a barrel, a hand grip, a release mechanism including a trigger, and a sight mount;

a riser attached to the fore end of the stock and having a center section providing a mounting for an arrow rest;

an arrow rest attached to the mounting;

a pair of limbs mounted to the riser, each limb having a proximal end connected to the riser and a distal end terminating at a tip;

a pair of idler spools, one mounted at each limb tip;

a pair of pockets mounted to the riser, the proximal end of each limb being pivotally mounted in a respective one of said pockets;

a limb bolt anchor pivotally connected to the riser by respective pylons adjacent each limb pocket;

an adjusting bolt adjustably connecting each limb pocket to its respective limb bolt anchor whereby bowstring tension can be altered or eliminated;

a pair of pylons, each comprising a pair side plates mounted on opposite sides of said riser;

a pair of cam and intermediate spool assemblies, each supported by a respective one of said pylons between said plates; and a synchronization system constraining the cams to rotate in unison.

2. The invention of claim 1, further comprising a stirrup attached to the stock to help one immobilize the crossbow while cocking it.

3. The invention of claim 1 wherein the release mechanism, the arrow rest, the riser and the barrel are configured so that an arrow may be placed so that it is supported at its front end by the arrow rest and at its rear end by its nock engaging the bowstring as the bowstring is held in a drawn position by the release mechanism, no other component engaging the arrow.

4. The invention of claim 1, wherein each cam and intermediate spool assembly has a buss cable connecting a minor lobe of the cam to an adjacent limb tip, and a control cable connecting a major lobe of the cam to an adjacent drive spool portion of the intermediate spool, and said intermediate spool has a bowstring spool portion accommodating a length of one end of the bowstring, said bowstring extending from a first bowstring spool to the adjacent limb tip where it is entrained around the idler spool and thence proceeds to the opposing idler spool located at the opposing limb tip and then to the second intermediate spool where it is connected to the second bowstring spool.

5. The invention of claim 4, wherein each cam and intermediate spool assembly is positioned between its supporting pylons in a manner that locates the buss cable extending from the minor lobe of the cam to the adjacent limb tip along the centerline of said limb tip and the centered idler spool, said buss cable being connected to said limb tip by supporting elements located adjacent either side of said idler spool.

6. The invention of claim 1, wherein each limb-mounting pocket is pivotally mounted to the end of the riser in a manner that facilitates engagement of a through-mounted limb adjustment bolt with a limb bolt anchor pivotally mounted to riser-mounted pylons such that both limb assemblies may be adjusted from zero system tension up to a maximum affordable draw weight determined by spring rates of the limbs and the cam/intermediate spool ratios.

7. The invention of claim 3, wherein the bowstring and buss cables lie in a center plane which bisects both limbs and the riser.

8. The invention of claim 1, wherein drawing the bowstring causes rotation of the intermediate spools which, by way of the connecting control cables, causes rotation of the cams which in turn, by way of the buss cables connecting the cams to the adjacent limb tips, causes the limbs to deflect, thus storing energy to be delivered to the arrow.

9. The invention of claim 8, wherein the synchronization system comprises a pair of synchronizing spools, each connected to a respective one of said cams for unitary rotation therewith and a pair of synchronizing cables interconnecting the synchronizing spools so that the synchronizing spools rotate at the same speed.

* * * * *